United States Patent [19]

Riaziat et al.

[11] Patent Number: 4,642,587

[45] Date of Patent: Feb. 10, 1987

[54] TAPERED FIVE-PORT WAVEGUIDE STAR JUNCTION

[75] Inventors: Majid Riaziat; George A. Zdasiuk, both of Palo Alto, Calif.

[73] Assignee: Varian Associates, Inc., Palo Alto, Calif.

[21] Appl. No.: 738,712

[22] Filed: May 29, 1985

[51] Int. Cl.[4] ..... H01P 5/12

[52] U.S. Cl. ..... 333/125; 333/137

[58] Field of Search ..... 333/125, 127, 128, 124, 333/123, 122, 121, 120, 117, 109, 136, 137

[56] References Cited

U.S. PATENT DOCUMENTS 2,941,166 6/1960 Meyer ..... 333/125
4,427,936 1/1984 Riblet et al. ..... 333/125

FOREIGN PATENT DOCUMENTS 0122084 10/1984 European Pat. Off. ..... 333/127
1202846 10/1965 Fed. Rep. of Germany ..... 333/128

OTHER PUBLICATIONS

Montgomery et al., "Principles of Microwave Circuits", MIT Radiation Laboratory Series; 1948, pp. 455–458.

Harvey, A. F., "Microwave Engineering"; 1963 Academic Press; pp. 730–731.

IEEE Trans. on Microwave Theory and Techniques, vol. MIT-31, No. 3, Mar. 1983, "An Ideal Six-Port Network Consisting of . . . ", E. R. Hanson and G. P. Riblet, pp. 284 et seq.

IEEE MIT-S Digest, May 1984, pp. 472–474, "Optimized Microstrip Ring-Star 5-Ports for Broadband 6-Port Measurement Applications," M. Malkomes, G. Kadisch, H. J. Schmitt.

"Principles of Microwave Circuits", pp. 455–459, NY, McGraw-Hill, 1948, =C. G. Montgomery, R. H. Dicke and E. M. Purcell.

*Primary Examiner*—Eugene R. LaRoche
*Assistant Examiner*—Benny T. Lee
*Attorney, Agent, or Firm*—Stanley Z. Cole; Kenneth L. Warsh

[57] ABSTRACT

A matched lossless reciprocal five-port junction can be constructed as a tapered five-fold symmetric star. The dimensions of the leads are tapered in toward the center, such that the cutoff frequency is the upper band frequency divided by 1.66.

2 Claims, 3 Drawing Figures

TAPERED FIVE-PORT WAVEGUIDE STAR JUNCTION

FIELD OF THE INVENTION

This invention relates to a five-port waveguide junction which operates in the frequency band of 26.5–40 GHz.

BACKGROUND OF THE INVENTION

The task is to match five transmission lines connected together. Some practical results have been reported using various ring and star schemes in microstrip and stripline media for frequencies up to 18 GHz. (See: E. R. Hansen and G. P. Riblet, "An Ideal Six-Port Network Consisting of Matched Reciprocal Five-Port and a Perfect Directional Coupler", IEEE Trans. Microwave Theory Tech., Vol. MTT-31, No. 3, pp. 284–288, March 1983, and M. Malkomes et al., "Optimized Microstrip Ring-Star Five-Ports for Broadband Six-Port Measurement Applications", in 1984 IEEE MTT-S Digest, pp. 472–474, May 1984). These matching technqiues employ standard matching sections using Computer Aided Design and are, therefore, restricted to TEM transmission media and low frequencies where CAD is available. A five-port waveguide junction suitable for millimeter wavelengths was not available in the prior art.

BRIEF SUMMARY OF THE INVENTION

According to the invention, a star junction configuration consisting of the intersection of five waveguides in the H plane, maintaining a five-fold rotational symmetry about the common axis, is inherently matched with a return loss of greater than 15 dB over a frequency range covering the lower portion of the waveguide band and extending outside the band. Expressed in terms of the cutoff frequency $f_c$ of the waveguide, the region of inherent match extends approximately from 1.14 $f_c$ to 1.66 $f_c$. The size of the junction must then be tapered such that the range of inherent match is shifted up in frequency to cover the entire waveguide band.

These and further constructional and operational characteristics of the invention will be more evident from the detailed description given hereinafter with reference to the figures of the accompanying drawings which illustrate preferred embodiment by way of non-limiting examples.

DESCRIPTION OF THE PREFERRED EMBODIMENT

Figure 1:
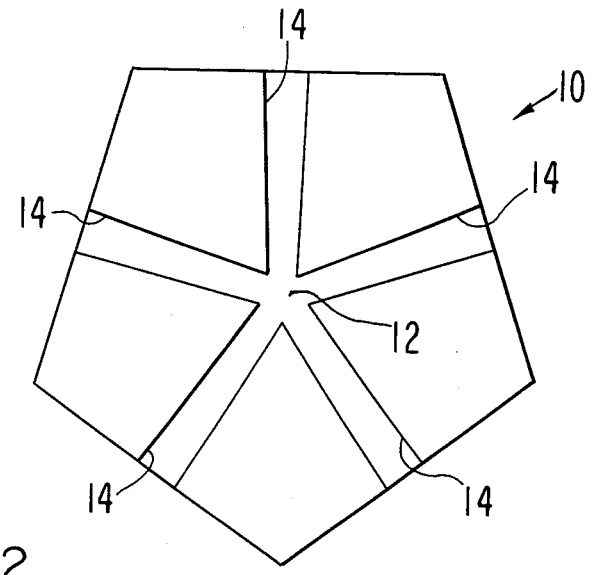
FIG. 1 shows a schematic top view of the junction according to the invention.

Referring now to the drawings wherein reference numerals are used to designate parts throughout the various figures thereof, there is shown in FIG. 1 a top view of a star junction 10 having a five-fold rotational symmetry. Five-fold rotational symmetry means that if the device is rotated by a fifth of a circle about an axis is of symmetry, it is identical to that before the rotation. The region of inherent match extends from 1.14 $f_c$ to 1.66 $f_c$ where $f_c$ is the cutoff frequency. For operation in Ka band (26.5 to 40 GHz), the size of the smaller waveguides characterized by the cutoff frequency $f_c'$ are obtained from the requirement 1.66 $f_c'$=40 GHz, leading to $f_c'$=24.1 GHz and the corresponding waveguide cross-section of 0.24×0.12 inches at the junction region 12. These dimensions are then tapered out to a cross-section of 0.280×0.140 inches for connection with WR28 waveguide used in Ka band in the tapered lead sections 14.

A star junction with five-fold rotational symmetry has three distinct S parameters. Namely $S_{11}$, $S_{12}$, and $S_{13}$. It has been shown that if such a lossless junction is completely matched, i.e., $S_{11}=0$, that $|S_{12}|=|S_{13}|=0.5$ and the phase angle between the two is 120°. (See: C. G. Montgomery, R. H. Dicke, and E. M. Purcell, "Principles of Microwave Circuits", pp. 455–459, New York: McGraw-Hill, 1948.) A five-port device with these properties can be used with a perfect directional coupler to make an ideal six-port for S parameter measurements. In practice, of course, the magnitude of $S_{11}$ is never zero, and the properties of the five-port are less than ideal. The following analysis is aimed at quantifying this, by finding the relationship between $S_{12}$ and $S_{13}$ when $S_{11}$ is not zero.

The three independent S parameters of the star junction are given in terms of its three scattering matrix eigenvalues $S_1$, $S_2$, and $S_3$ as follows:

$$S_{11}=(S_1+2S_2+2S_3)/5, \tag{1}$$

$$S_{12}=(S_1+2S_2\cos(2Pi/5)-2S_3\cos(Pi/5))/5 \tag{2}$$

$$S_{12}=(S_1-2S_2\cos(pi/5)+2S_3\cos(2Pi/5))/5 \tag{3}$$

The magnitude of each eigenvalue is unity for a lossless junction. The phase angle of one of the eigenvalues can be set arbitrarily. This corresponds to the choice of the reference plane at each port. The choice we make here is $$S_1=-1S_2=e^{i\theta 2}S_3=e^{i\theta 3}. \tag{4}$$

Since the reference planes are now fixed, $S_{11}$ has well defined real and imaginary parts. Given real and imaginary parts of $S_{11}$, the values of $\theta_2$ and $\theta_3$ can be determined from Eqn. (1). Written more explicitly, $\theta_2$ is determined from the quadratic equation $$\cos^2(\theta_2)-\tfrac{1}{2}(5Re(S_{11})+1)\cos(\theta_2)+16F(S_{11})-\frac{25(Im(S_{11}))^2}{F(S_{11})}=0, \tag{5}$$

where $F(S_{11})=(5Re(S_{11})+1)^2+(5Im(S_{11}))^2$. The other angle $\theta_3$ is obtained by direct substitution into (1). Knowing the eigenvalues in terms of $S_{11}$, the other two S parameters may be found from Eqns. (2) and (3). Exceptionally simple results are obtained if we assume that $S_{11}$ is real:

$$Re(S_{12})=Re(S_{13})=-0.25(1+S_{11}),$$
$$Im(S_{12})=-Im(S_{13})=0.25(3-2S_{11}-5(S_{11})^2)^{\frac{1}{2}}. \tag{6}$$

Figure 2:
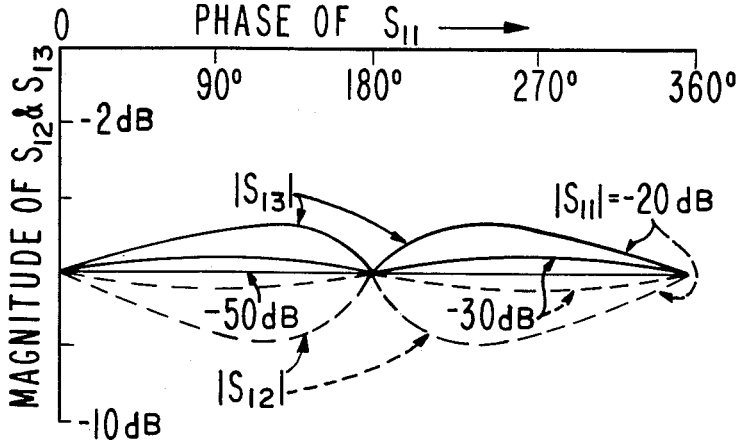
FIG. 2 shows the magnitude of $S_{12}$ and $S_{13}$ as a function of magnitude and phase of $S_{11}$.
Figure 3:
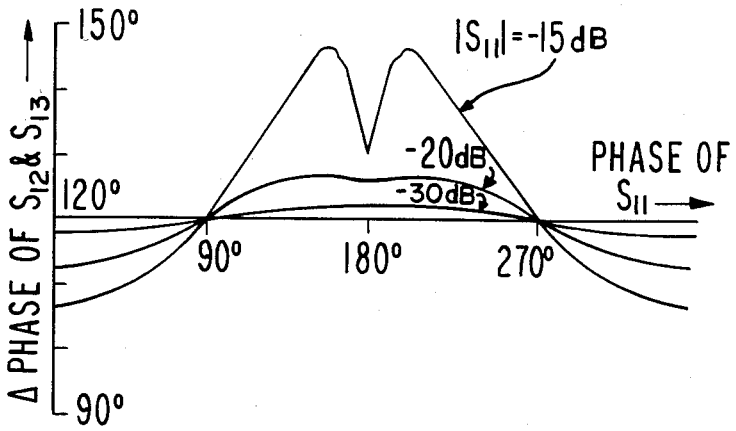
FIG. 3 shows phase difference between $S_{12}$ and $S_{13}$ as a function of magnitude and phase of $S_{11}$.

Equations (6) show that even a poorly matched junction is a good power divider under these conditions. The condition on the phase of $S_{11}$ cannot be practically enforced, however, and it is necessary to find the behavior of the S parameters as a function of both magnitude and phase of the reflection coefficient. This is done numerically using (5), with the results given in FIGS. 2 and 3. $S_{11}$ is the reflection coefficient of any one of the ports when all the rest are terminated in matched loads. $S_{12}$ is the coupling coefficient between two adjacent ports and $S_{13}$ is the coupling coefficient between two non-adjacent ports. In FIG. 2, the solid curves refer to $|S_{13}|$, the upper of these being at $|S_{11}|$ held constant at $-20$ dB, the next curves being at $|S_{11}|$ held constant at $-30$ dB, and the center line being at $|S_{11}|$ held constant at $-50$ dB. The dashed curves refer to $|S_{12}|$, the lowest of these being for $|S_{11}|$ held constant at $-20$ dB, the second lowest being at $|S_{11}|$ held constant at $-30$ dB, and the center line being the same as that for $|S_{13}|$ with $|S_{11}|$ held constant at $-50$ dB. In FIG. 3, the uppermost curve is for the phase difference where $|S_{11}|$ is held constant at $-15$ dB, the middle curve is where $|S_{11}|$ is held constant at $-20$ dB and the lowest curve is where $|S_{11}|$ is held constant at $-30$ dB. These results show the extent of deviation from ideal behavior that can be expected from a junction with a given magnitude of $S_{11}$. Also, if the magnitudes of $S_{11}$, $S_{12}$ and $S_{13}$ are known, the phase angles of $S_{12}$ and $S_{13}$ can be estimated from FIGS. 2 and 3. Even though characteristics deviate from the ideal model, the results demonstrate sufficient accuracy for laboratory use. Among other merits of this design are relative speed of measurements and small capital investment.

This invention is not limited to the preferred embodiments heretofore described, to which variations and improvements may be made, without leaving the scope of protection of the present patent, the characteristics of which are summarized in the following claims.

We claim:

1. A microwave junction assembly for matching five rectangular waveguides, over a frequency band having an upper frequency band edge and a lower frequency band edge, comprising:

five tapered waveguide lead sections lying in the H-plane in a five-fold rotational symmetry around an axis of rotational symmetry perpendicular to said H-plane, said sections leading from a periphery at one end of said waveguide lead sections into a central junction region located on said axis and at an opposite end of said waveguide lead sections, each tapered waveguide lead section being tapered in a direction, in both cross-sectional dimensions, from said periphery to said central junction, each cross-sectional dimension being reduced by a factor of about 6/7 over the direction of the taper.

2. A microwave junction assembly as in claim 1 wherein said junction is matched to the Ka microwave band by tapering each of said waveguide lead sections from dimensions of about 0.28 by 0.14 inches to about 0.24 by 0.12 inches in cross-section at said junction region.

* * * * *